US010971835B2

(12) United States Patent
Feng

(10) Patent No.: US 10,971,835 B2
(45) Date of Patent: Apr. 6, 2021

(54) ELECTRICAL CONNECTOR

(71) Applicant: LOTES CO., LTD, Keelung (TW)

(72) Inventor: Zhi Jun Feng, Keelung (TW)

(73) Assignee: LOTES CO., LTD, Keelung (TW)

( * ) Notice: Subject to any disclaimer, the term of this patent is extended or adjusted under 35 U.S.C. 154(b) by 3 days.

(21) Appl. No.: 16/521,873

(22) Filed: Jul. 25, 2019

(65) Prior Publication Data

US 2020/0036122 A1 Jan. 30, 2020

(30) Foreign Application Priority Data

Jul. 30, 2018 (CN) ..... 201810853958.3
Feb. 15, 2019 (CN) ..... 201910115580.1

(51) Int. Cl.

| | |
|---|---|
| ***H01R 12/71*** | (2011.01) |
| ***H01R 13/502*** | (2006.01) |
| ***H01R 13/6461*** | (2011.01) |
| ***H01R 13/6473*** | (2011.01) |
| ***H01R 13/6581*** | (2011.01) |

(52) U.S. Cl.

CPC ..... *H01R 12/716* (2013.01); *H01R 13/502* (2013.01); *H01R 13/6461* (2013.01); *H01R 13/6473* (2013.01); *H01R 13/6581* (2013.01)

(58) Field of Classification Search

CPC ..... H01R 13/6477; H01R 13/6474; H01R 13/648

See application file for complete search history.

(56) References Cited

U.S. PATENT DOCUMENTS

| | | | | |
|---|---|---|---|---|
| 5,955,888 | A * | 9/1999 | Frederickson | G01R 31/2886 324/750.25 |
| 6,932,618 | B1 | 8/2005 | Nelson | |
| 7,177,142 | B2 * | 2/2007 | Kabadi | H05K 3/308 257/779 |
| 8,525,346 | B2 * | 9/2013 | Rathburn | B82Y 10/00 257/774 |
| 8,827,730 | B2 * | 9/2014 | Ihara | H01R 12/88 439/206 |
| 10,104,772 | B2 * | 10/2018 | Berge | B23K 1/19 |
| 2006/0091538 | A1 * | 5/2006 | Kabadi | H05K 7/1061 257/737 |
| 2009/0124100 | A1 * | 5/2009 | Mason | H05K 7/1061 439/66 |
| 2012/0262862 | A1 * | 10/2012 | Johnson | H01L 23/4985 361/679.02 |

FOREIGN PATENT DOCUMENTS

| | | |
|---|---|---|
| CN | 103503248 A | 1/2014 |
| CN | 103855544 B | 2/2016 |
| CN | 102904127 B | 8/2016 |

* cited by examiner

*Primary Examiner* — Jean F Duverne
(74) *Attorney, Agent, or Firm* — Locke Lord LLP; Tim Tingkang Xia, Esq.

(57) ABSTRACT

An electrical connector is mounted on a circuit board and used to mate with a mating member. The electrical connector includes: a body made of a wave-absorbing material, the body having an upper surface, a lower surface and at least one first accommodating groove; and at least one ground terminal accommodated in the first accommodating groove. An upper end of the ground terminal is exposed to the upper surface and is in electrical contact with the mating member, and a lower end of the ground terminal is exposed to the lower surface and is electrically connected with the circuit board.

19 Claims, 6 Drawing Sheets

X
Y
1A
1B
L1
L2
L1
L2
L3
L2
L3
A
A
10
14
1
12
21
21
13
22
31
30
23
23
3
31
22
21
21
21

ELECTRICAL CONNECTOR

CROSS-REFERENCE TO RELATED PATENT APPLICATION

This non-provisional application claims priority to and the benefit of, pursuant to 35 U.S.C. § 119(a), patent application Serial No. CN201810853958.3 filed in China on Jul. 30, 2018, and patent application Serial No. CN201910115580.1 filed in China on Feb. 15, 2019. The disclosures of the above applications are incorporated herein in their entireties by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and in particular to an electrical connector capable of preventing electromagnetic interference.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A conventional electrical connector is used to electrically connect a mating member and a circuit board. The circuit board has a grounding sheet. The electrical connector has a conductive body, which is electrically connected with the grounding sheet. The conductive body has multiple through holes which correspondingly accommodate multiple supporting blocks, and each supporting block and multiple terminals are injection-molded. The terminals include a pair of differential signal terminals and a ground terminal. The conductive body shields a magnetic field of the differential signal terminals, such that multiple pairs of differential signal terminals are free from electromagnetic interference with the purpose of reducing an insertion loss and a return loss. Thus, the high frequency characteristics of the electrical connector are good accordingly. The supporting block is made of an insulating and non-conductive material, such that short-circuiting between multiple terminals does not occur.

The conductive body does shield the magnetic field of the differential signal terminal. However, the capacitance characteristics of the terminal are affected, the characteristic impedance of the terminal is reduced, the insertion loss and the return loss are increased, and therefore the high frequency characteristics of the electrical connector cannot be well improved.

Therefore, a heretofore unaddressed need to design a new electrical connector exists in the art to address the aforementioned deficiencies and inadequacies.

SUMMARY

The present invention is directed to an electrical connector having a body made of a wave-absorbing material to absorb a magnetic field and reduce the insertion loss and the return loss.

To achieve the foregoing objective, the present invention adopts the following technical solutions: an electrical connector is mounted on a circuit board and configured to mate with a mating member. The electrical connector includes: a body made of a wave-absorbing material, the body having an upper surface, a lower surface and at least one first accommodating groove; and at least one ground terminal, accommodated in the first accommodating groove, wherein an upper end of the ground terminal is exposed to the upper surface and is in electrical contact with the mating member, and a lower end of the ground terminal is exposed to the lower surface and is electrically connected with the circuit board.

In certain embodiments, the electrical connector further includes a signal module, wherein the signal module has at least one signal terminal and a plastic block wrapping the signal terminal, the body has at least one installation hole, the plastic block is accommodated in the installation hole, an upper end of the signal terminal is exposed to the upper surface and is in electrical contact with the mating member, a lower end of the signal terminal is exposed to the lower surface and is electrically connected with the circuit board, and the signal terminal and the body are not in contact with each other.

In certain embodiments, the body further has at least one second accommodating groove located at one side of the installation hole and is communicated with the installation hole, at least one shielding terminal is accommodated in the second accommodating groove and is partially exposed to the installation hole, an upper end of the shielding terminal is in electrical contact with the mating member, and a lower end of the shielding terminal is electrically connected with the circuit board.

In certain embodiments, the second accommodating groove is concavely formed on an inner wall of the installation hole.

In certain embodiments, the plastic block has at least one notch configured to reserve a space for the corresponding shielding terminal, and an inner wall of the notch and an inner wall of the second accommodating groove jointly clamp the corresponding shielding terminal.

In certain embodiments, the shielding terminal is cylindrical, and the shielding terminal and the second accommodating groove are provided to attach each other and jointly define an attachment radian, wherein the attachment radian is greater than or equal to 180°.

In certain embodiments, the electrical connector includes a plurality of ground terminals, the signal module has a plurality of signal terminals, a front-rear direction and a left-right direction are defined, a size of the installation hole in the front-rear direction is smaller than a size of the installation hole in the left-right direction, the body further has a plurality of first accommodating grooves and a plurality of installation holes configured to accommodate the ground terminals and the signal terminals respectively, each two of the installation holes are not communicated, the body defines a first straight line and a second straight line parallel to each other and provided in the front-rear direction, the first accommodating grooves and the installation holes are arranged in a first row and a second row, the first row is provided along the first straight line and comprises a plurality of the first accommodating grooves and at least one of the installation holes, and the second row is provided along the second straight line and comprises a plurality of the first accommodating grooves and at least one of the installation holes.

In certain embodiments, the installation hole on the first straight line and the installation hole on the adjacent second straight line are staggeredly provided.

In certain embodiments, the body defines two first straight lines, the two first straight lines and the second straight line are parallel to each other and provided in the front-rear direction, the first accommodating grooves and the installation holes are arranged in two first rows and one second row, each of the first rows is provided along one of the first straight lines and comprises a plurality of the first accommodating grooves and at least one of the installation holes, the second row is provided along the second straight line and comprises a plurality of the first accommodating grooves and at least one of the installation holes, and at least one of the ground terminals provided along the second straight line is located between the installation holes provided along the two first straight lines.

In certain embodiments, each of the signal terminals is aligned to one of the ground terminals in the front-rear direction.

In certain embodiments, the body further defines a third straight line parallel to the first straight line and the second straight line, the first straight line, the second straight line and the third straight line are provided in the front-rear direction, the first accommodating grooves and the installation holes are arranged in the first row, the second row and a third row, the third row is provided along the third straight line and comprises only a plurality of the first accommodating grooves.

In certain embodiments, the plastic block has at least one rigid bump abutting an inner wall of the installation hole.

In certain embodiments, the rigid bump and the inner wall of the installation hole are in point contact.

In certain embodiments, the plastic block has an outer side surface facing an inner wall of the installation hole, and the outer side surface at least partially attaches to the inner wall of the installation hole.

In certain embodiments, the ground terminal is cylindrical shaped, and an inner wall of the first accommodating groove is circular shaped matching with a circular outer surface of the ground terminal.

To achieve the foregoing objective, the present invention adopts the following technical solutions: an electrical connector is mounted on a circuit board and configured to mate with a mating member. The electrical connector includes: a body made of a wave-absorbing material, the body having an installation hole; a plastic block, accommodated in the installation hole; at least one signal terminal, provided in the plastic block, and configured to electrically connect the circuit board and the mating member; and at least one shielding terminal, accommodated in the installation hole and located at an outer side of the plastic block, wherein the shielding terminal is in contact with the body.

In certain embodiments, the electrical connector further includes at least one ground terminal, wherein the body has at least one first accommodating groove, and the ground terminal is accommodated in the first accommodating groove and abuts an inner wall of the first accommodating groove.

In certain embodiments, the body has at least one second accommodating groove configured to accommodate the shielding terminal, and the second accommodating groove is communicated with the installation hole.

In certain embodiments, the shielding terminal is cylindrical, and the shielding terminal and the second accommodating groove are provided to attach each other and jointly define an attachment radian, wherein the attachment radian is greater than or equal to 180°.

In certain embodiments, the plastic block has at least one notch configured to reserve a space for the corresponding shielding terminal, and an inner wall of the notch and an inner wall of the second accommodating groove jointly clamp the corresponding shielding terminal.

Compared with the related art, the ground terminal abuts the wall surface of the first accommodating groove, such that the resonance of the ground terminal can be well eliminated. Further, the ground terminal is in contact with the wall surface of the first accommodating groove, such that a magnetic field absorbed by a body is transmitted out of the electrical connector, thereby facilitating reducing the magnetic field interference of a differential signal terminal, adjusting the characteristic impedance of the terminal, and reducing the insertion loss and the return loss.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
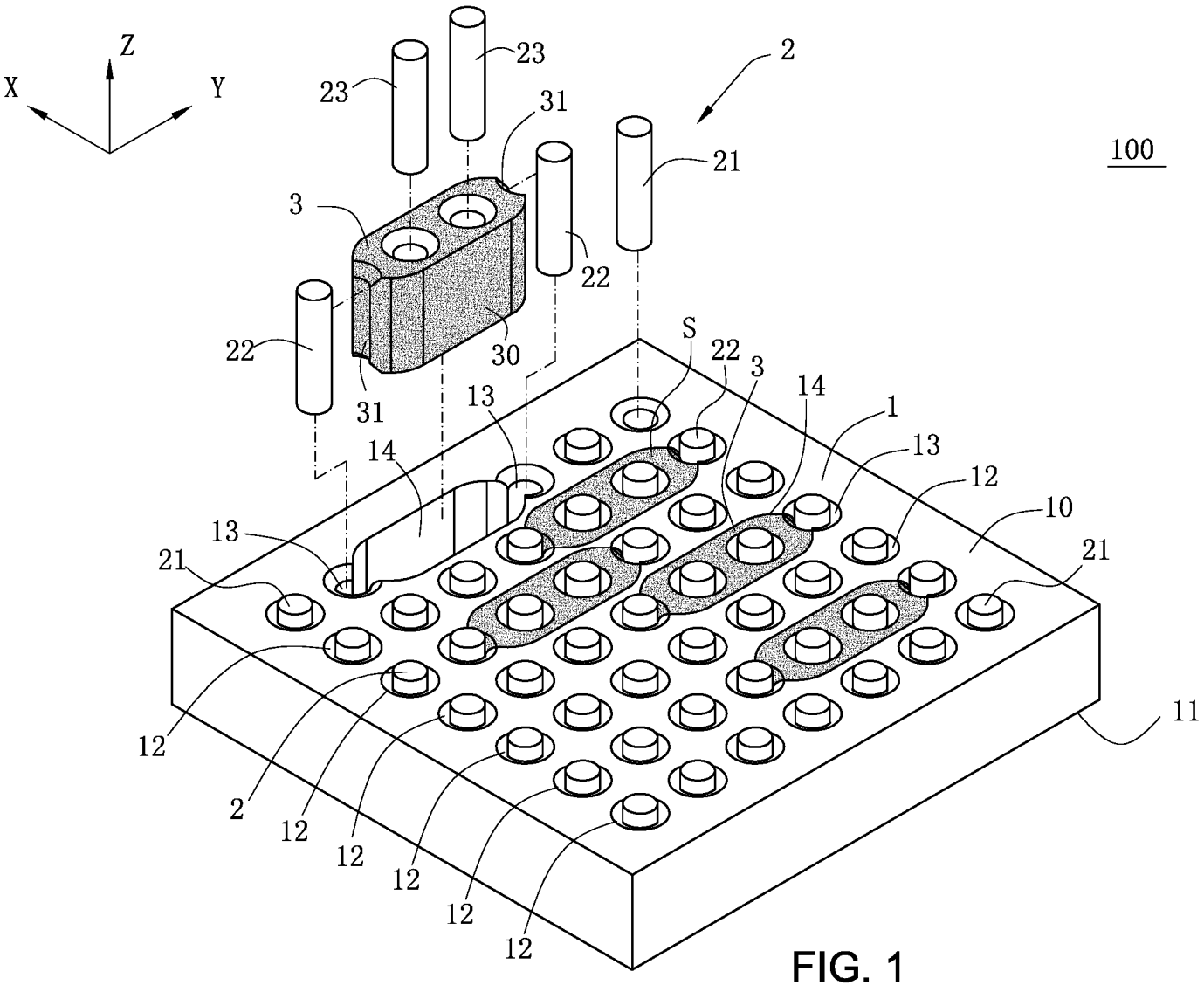
FIG. 1 is a perspective exploded view of an electrical connector according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-6. In accordance with the purposes of this invention, as embodied and broadly described herein, this invention, in one aspect, relates to an electrical connector.

For accuracy of the descriptions, in any description of the present invention related to directions, an X-axis is defined to extend along a front-rear direction (where the forward direction is the positive direction of the X-axis), a Y-axis is defined to extend along a left-right direction (where the rightward direction is the positive direction of the Y-axis), and a Z-axis is defined to extend along a vertical direction (where the upward direction is the positive direction of the Z-axis).

Figure 2:
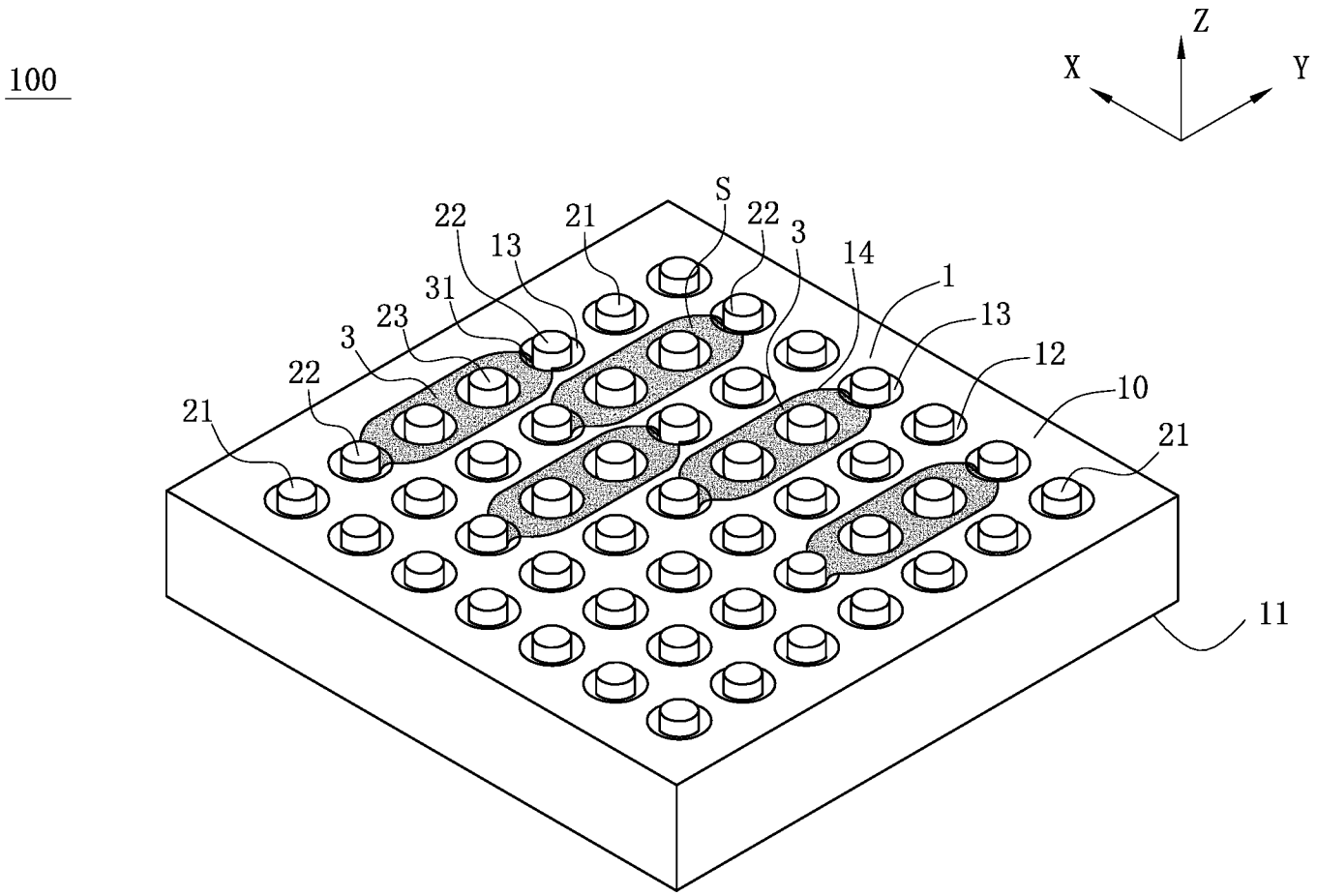
FIG. 2 is a perspective assembly view of the electrical connector in FIG. 1.
Figure 4:
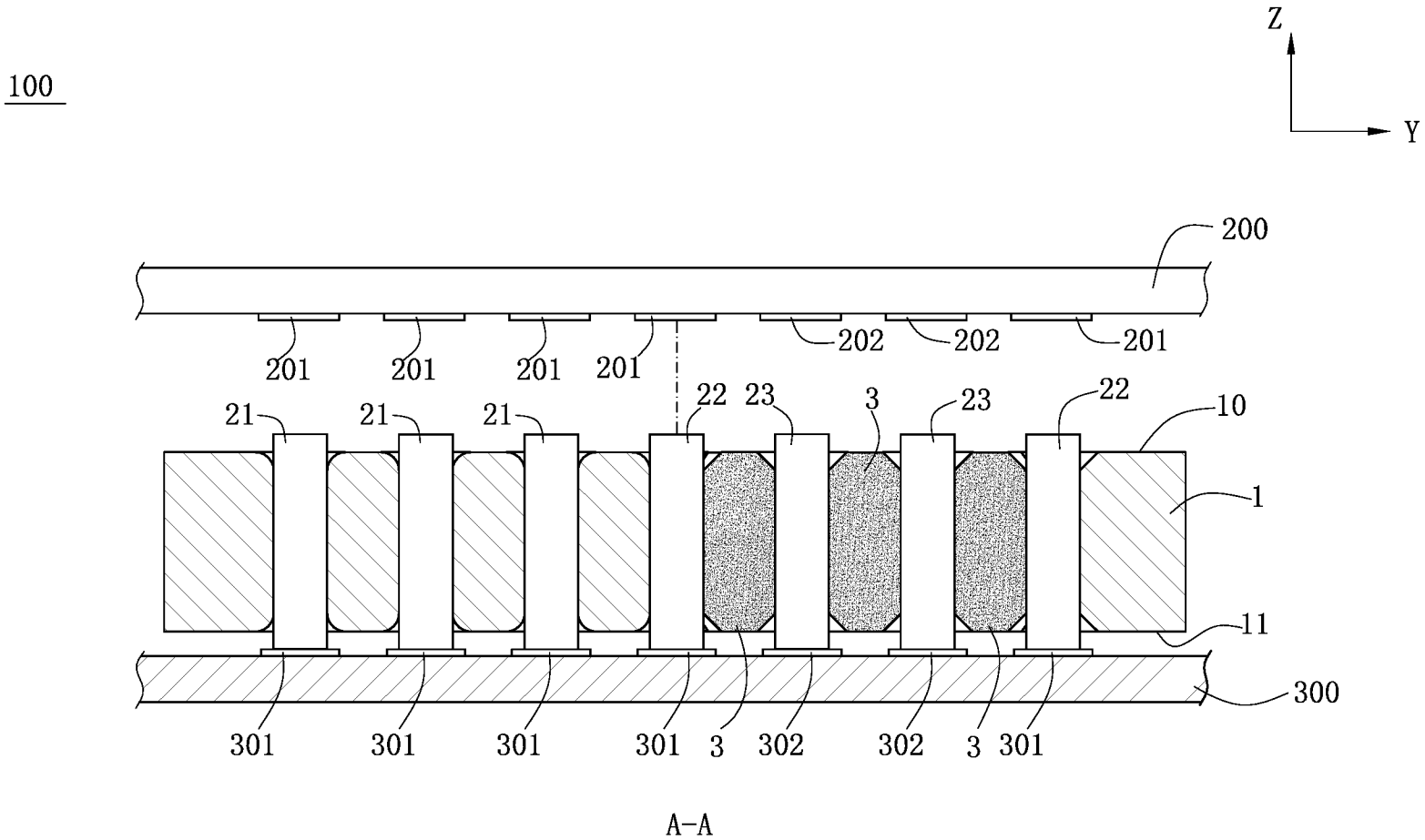
FIG. 4 is a sectional view of the electrical connector in FIG. 3 along the A-A direction.

FIG. 1, FIG. 2 and FIG. 4 show an electrical connector 100 according to a first embodiment of the present invention. The electrical connector is used to electrically connect a mating member 200 and a circuit board 300. The mating member 200 has multiple grounding gaskets 201 and multiple signal gaskets 202, and the circuit board 300 has multiple grounding metal sheets 301 and multiple signal metal sheets 302. The electrical connector 100 includes a body 1 and multiple terminals 2 provided in the body 1.

Figure 3:
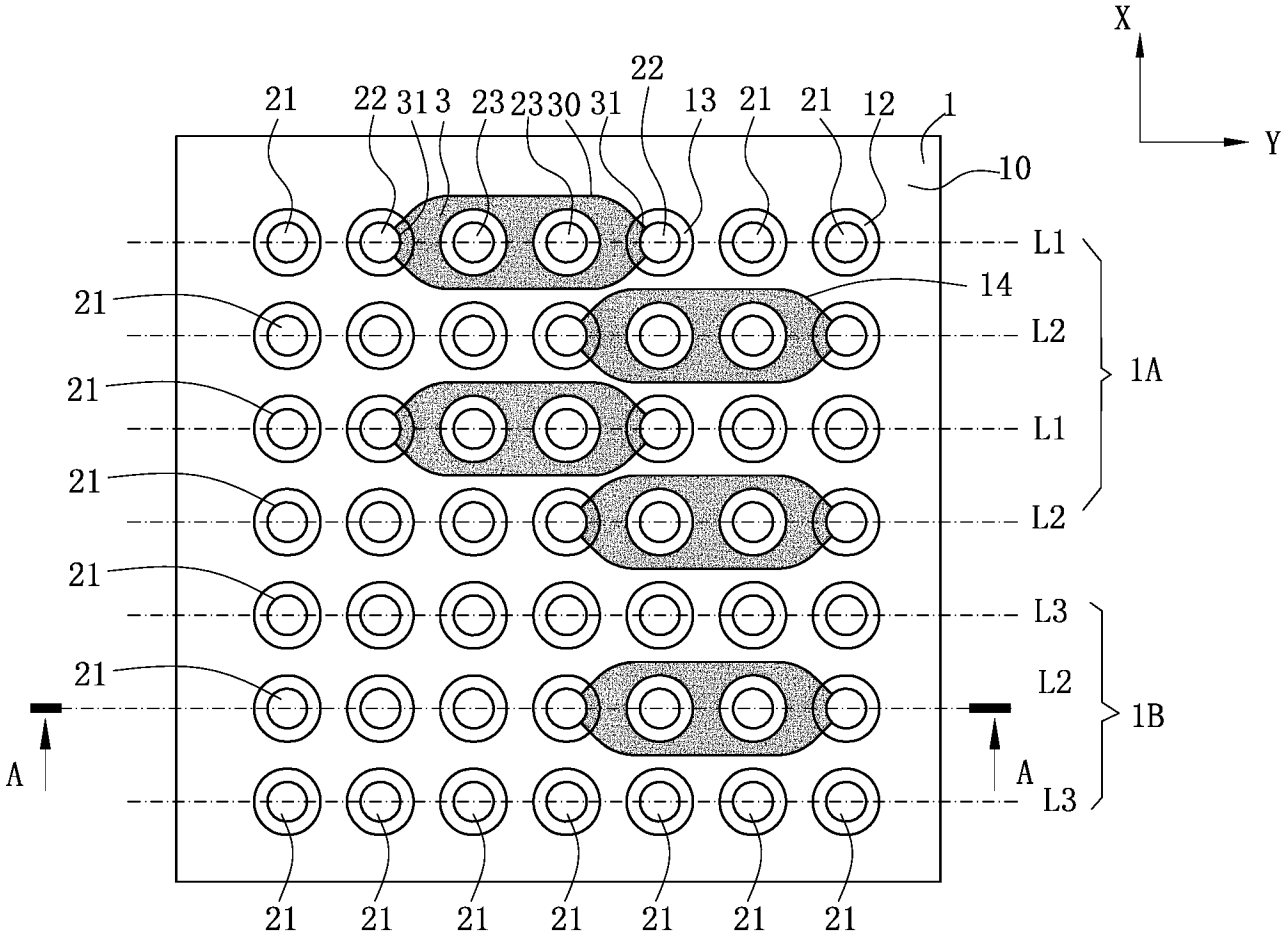
FIG. 3 is a top view of the electrical connector in FIG. 2.

Referring to FIG. 1, FIG. 2 and FIG. 3, the body 1 is made of a high-magnetic conductive wave-absorbing material. The high-magnetic conductive wave-absorbing material in the present embodiment refers to a material which absorbs electromagnetic energy and converts the electromagnetic energy into heat energy. The body 1 has an upper surface 10 and a lower surface 11, as well as multiple first accommodating grooves 12, multiple second accommodating grooves 13 and multiple installation holes 14 running through the upper surface 10 and the lower surface 11. Each two installation holes 14 are provided at an interval and are not communicated. That is, a wave-absorbing material is filled between each two installation holes 14. Each first accommodating groove 12 is a circular hole. Each installation hole 14 extends in a left-right direction lengthwise, such that the size of the installation hole 14 in the left-right direction is greater than the size of the installation hole 14 in a front-rear direction, and the installation hole 14 is narrowed in its left and right ends. Each of the left and right sides of each installation hole 14 is provided with a second accommodating groove 13 respectively. Each second accommodating groove 13 is concavely provided on an end wall at each of the left side and the right side of the corresponding installation hole 14. Each second accommodating groove 13 is an arc-shaped hole, and an arc-shaped opening thereof faces the installation hole 14.

Referring to FIG. 3, the body 1 defines multiple virtual straight lines, including multiple first straight lines L1, multiple second straight lines L2 and multiple third straight lines L3 extending along the left-right direction and provided in parallel to one another in the front-rear direction. The body 1 has a first area 1A and a second area 1B located behind the first area 1A. The first straight lines L1 and the second straight lines L2 are alternately provided at intervals on the first area 1A, and multiple second straight lines L2 and multiple third straight lines L3 are alternately provided at intervals on the second area 1B. The first accommodating grooves 12, the second accommodating grooves 13 and the installation holes 14 on the body 1 are arranged in multiple first rows, multiple second rows and multiple third rows. Each first row is arranged along one of the first straight lines L1, each second row is arranged along one of the second straight lines L2, and each third row is arranged along one of the third straight lines L3. Each of the first rows and the second rows includes one installation hole 14, two of the second accommodating grooves 13 respectively located on the left and right sides of this installation hole 14, and multiple first accommodating grooves 12. Each third row includes only multiple first accommodating grooves 12. The installation hole 14 on each of the first straight lines L1 and the installation hole 14 on each of the second straight lines L2 are staggeredly provided and are partially overlapped in the front-rear direction. The two first accommodating grooves 12 on one second straight line L2 are provided between the installation holes 14 on two adjacent first straight lines L1.

Referring to FIG. 1, FIG. 2 and FIG. 3, each terminal 2 is cylindrical, and has the same diameter and height. An upper end of each terminal 2 extends upward beyond the upper surface 10 and is in electrical contact with the mating member 200, and a lower end of each terminal 2 extends downward beyond the lower surface 11 and is electrically connected with the circuit board 300. The terminals 2 include multiple ground terminals 21, multiple shielding terminals 22 and multiple differential signal terminals 23. The ground terminals 21 are accommodated in the first accommodating grooves 12 respectively. The shielding terminals 22 are accommodated in the second accommodating grooves 13 and partially exposed in the installation holes 14. The differential signal terminals 23 are accommodated in the installation holes 14.

Referring to FIG. 1, FIG. 3 and FIG. 4, each ground terminal 21 are electrically connected to a corresponding grounding gasket 201 and a corresponding grounding metal sheet 301. The cylindrical side surface of each ground terminal 21 and the wall surface of the corresponding first accommodating groove 12 are attached and abut in a face-to-face manner. In the related art, where the ground terminals are embedded into the supporting blocks, and a clearance is formed between each ground terminal and the wall surface of a through hole. Compared with the related art, in the present embodiment, each ground terminal 21 and the wall surface of the corresponding first accommodating groove 12 are attached and abut face-to-face, such that a certain contact area is ensured, and the resonance of the ground terminal 21 can be well eliminated. Moreover, each ground terminal 21 is in contact with the wall surface of the corresponding first accommodating groove 12, such that a magnetic field absorbed by the body 1 is conducted out of the electrical connector 100, thereby facilitating reducing the magnetic field interference of the differential signal terminal 23, adjusting the characteristic impedance of the terminal 2, and reducing the insertion loss and the return loss.

Referring to FIG. 1, FIG. 3 and FIG. 4, each differential signal terminal 23 is electrically connected to a corresponding signal gasket 202 and a corresponding signal metal sheet 302, and is used to transmit a high frequency signal between the mating member 200 and the circuit board 300. The multiple pairs of differential signal terminals 23 and multiple plastic blocks 3 are injection-molded one-by-one to form multiple signal modules S, and the signal modules S are correspondingly inserted into the installation holes 14. The plastic block 3 is made of an LCP material, or other insulating and non-magnetic conductive materials. The plastic block 3 wraps each differential signal terminal 23, such that the differential signal terminals 23 and the body 1 are not in contact with each other. The body 1 is made of a wave-absorbing material capable of absorbing magnetic field energy, which absorbs an outwardly radiated magnetic field of a pair of differential signal terminals 23 and absorbs magnetic field energy between a pair of differential signal terminals 23. If the differential signal terminals 23 are in direct contact with the body 1, the signal transmission of the differential signal terminals 23 will be affected, which is not conducive to the electrical property of the electrical connector 100. Thus, in the present embodiment, the differential signal terminals 23 are in contact with the body 1.

Referring to FIG. 1, FIG. 3 and FIG. 4, the plastic block 3 has an outer side surface 30, which faces the wall surface of the corresponding installation hole 14 and is tightly attached to the wall surface of the installation hole 14 in a face-to-face manner. Both left and right ends of the plastic block 3 are narrowed and match with the narrowed left and right ends of the installation hole 14 respectively, so as to facilitate guiding the plastic block 3 into the installation hole 14. Moreover, the attachment between the outer side surface 30 and the wall surface of the installation hole 14 improves the positioning effect of the plastic block 3, thus improving the positioning effect of the differential signal terminals 23, and facilitating the electrical property of the electrical connector 100.

Two notches 31 are concavely provided on the outer side surface 30. The two notches 31 are symmetrically provided at the left and right ends of the plastic block 3. Each notch 31 is an arc-shaped hole, and an arc-shaped opening thereof faces the corresponding second accommodating groove 13.

Referring to FIG. 1, FIG. 3 and FIG. 4, each shielding terminal 22 is accommodated in a corresponding second accommodating groove 13 and is partially exposed in the corresponding installation hole 14, and the arc-shaped hole formed by the corresponding notch 31 reserves a space for a portion of the shielding terminal 22 exposed in the installation hole 14. Each shielding terminal 22 is clamped by the wall surface of the corresponding second accommodating groove 13 and the wall surface of the corresponding notch 31 in the left-right direction, and the shielding terminal 22 and the wall surface of the second accommodating groove 13 attach to define an attachment radian which is greater than or equal to 180°. In the present embodiment, the attachment radian of each shielding terminal 22 and the corresponding second accommodating groove 13 is 270°. The wall surface of the corresponding notch 31 and the portion of the shielding terminal 22 exposed in the corresponding installation hole 14 also attach to define an attachment radian. In the present embodiment, the attachment radian of each shielding terminal 22 and the corresponding notch 31 is 90°.

Each shielding terminal 22 is electrically connected to a corresponding grounding gasket 201 and a corresponding grounding metal sheet 301, and a current loop is formed between the shielding terminal 22 and the adjacent differential signal terminal 23. Since each shielding terminal 22 is exposed in the installation hole 14 and attached to the wall surface of the notch 31, the plastic block 3 is partially provided between the shielding terminal 22 and the adjacent differential signal terminal 23, and the magnetic field energy between the shielding terminal 22 and the adjacent differential signal terminal 23 is not absorbed by the wave-absorbing material, thereby facilitating the stabilization of the current loop, further keeping stable impedance, and thus facilitating the electrical property of the electrical connector 100.

Referring to FIG. 2 and FIG. 3, the ground terminals 21, the shielding terminals 22 and the signal modules S are inserted into the first accommodating grooves 12, the second accommodating grooves 13 and the installation holes 14 respectively. A pair of differential signal terminals 23 on the first straight line L1 and a pair of differential signal terminals 23 on the adjacent second straight line L2 are staggeredly provided in the front-rear direction on the first area 1A, and the installation hole 14 on the first straight line L1 and the installation hole 14 on the adjacent second straight line L2 are provided at an interval and are not communicated with each other. A wave-absorbing material exists between two pairs of differential signal terminals 23 in front and rear rows to absorb a magnetic field between the two pairs of differential signal terminals 23 in the front and rear rows, thereby reducing the crosstalk between the two pairs of differential signal terminals 23 in the front and rear rows, reducing the insertion loss and the return loss, and facilitating the high frequency performance of the electrical connector 100.

The installation holes 14 in two adjacent first straight lines L1 are provided at an interval and are not communicated with each other, and a wave-absorbing material is provided between two pairs of differential signal terminals 23 on the two adjacent first straight lines L1 and absorbs a magnetic field, thereby reducing the crosstalk, reducing the insertion loss and the return loss, and facilitating the high frequency performance of the electrical connector 100. Moreover, one of the ground terminals 21 and one of the shielding terminals 22 are provided between the two pairs of differential signal terminals 23 on the two adjacent first straight lines L1, thereby enhancing the shielding effect on a magnetic field between the two pairs of differential signal terminals 23 on the two adjacent first straight lines L1, reducing the crosstalk, reducing the insertion loss and the return loss, and facilitating the high frequency performance of the electrical connector 100.

A row of ground terminals 21 are provided between two pairs of differential signal terminals 23 on two adjacent second straight lines L2 on the second area 1B, and the installation holes 14 in the adjacent second straight lines L2 are provided at an interval and are not communicated with each other, such that a wave-absorbing material is provided between the two pairs of differential signal terminals 23 on the second straight lines L2 and used for absorbing a magnetic field, and the ground terminal 21 is provided for enhancing the shielding effect, thereby facilitating the high frequency performance of the electrical connector 100.

In the present embodiment, the signal module S may be formed by insert-molding of the plastic block 3, a pair of differential signal terminals 23 and two shielding terminals 22. Each shielding terminal 22 is embedded into the plastic block 3, and is partially exposed out of the plastic block 3. When the signal module S is inserted into the body 1, the signal module S matches with the installation hole 14 and the second accommodating grooves 13 at both ends thereof, such that the installation process is simplified, thereby facilitating the installation.

Figure 5:
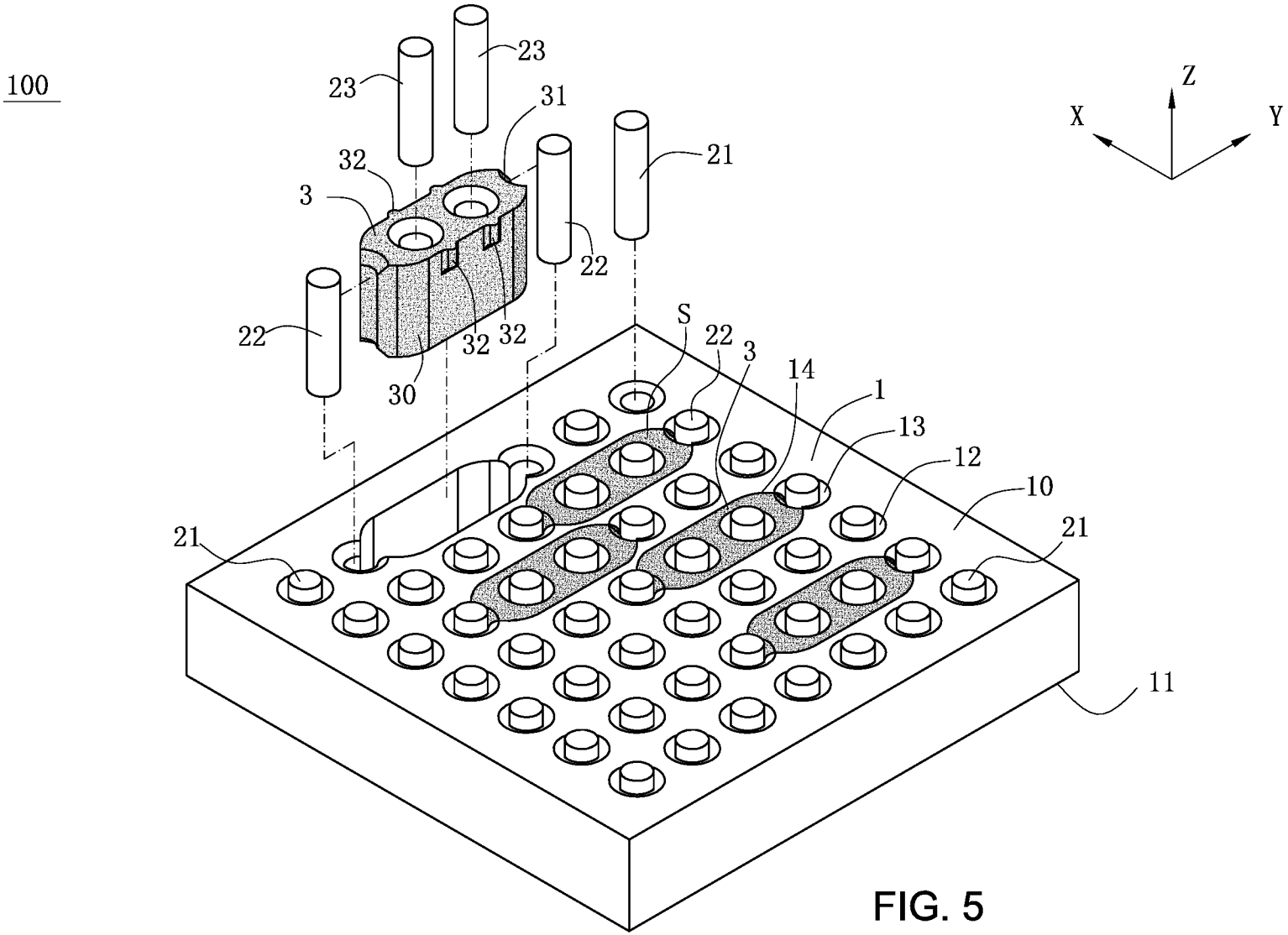
FIG. 5 is a perspective exploded view of an electrical connector according to a second embodiment of the present invention.
Figure 6:
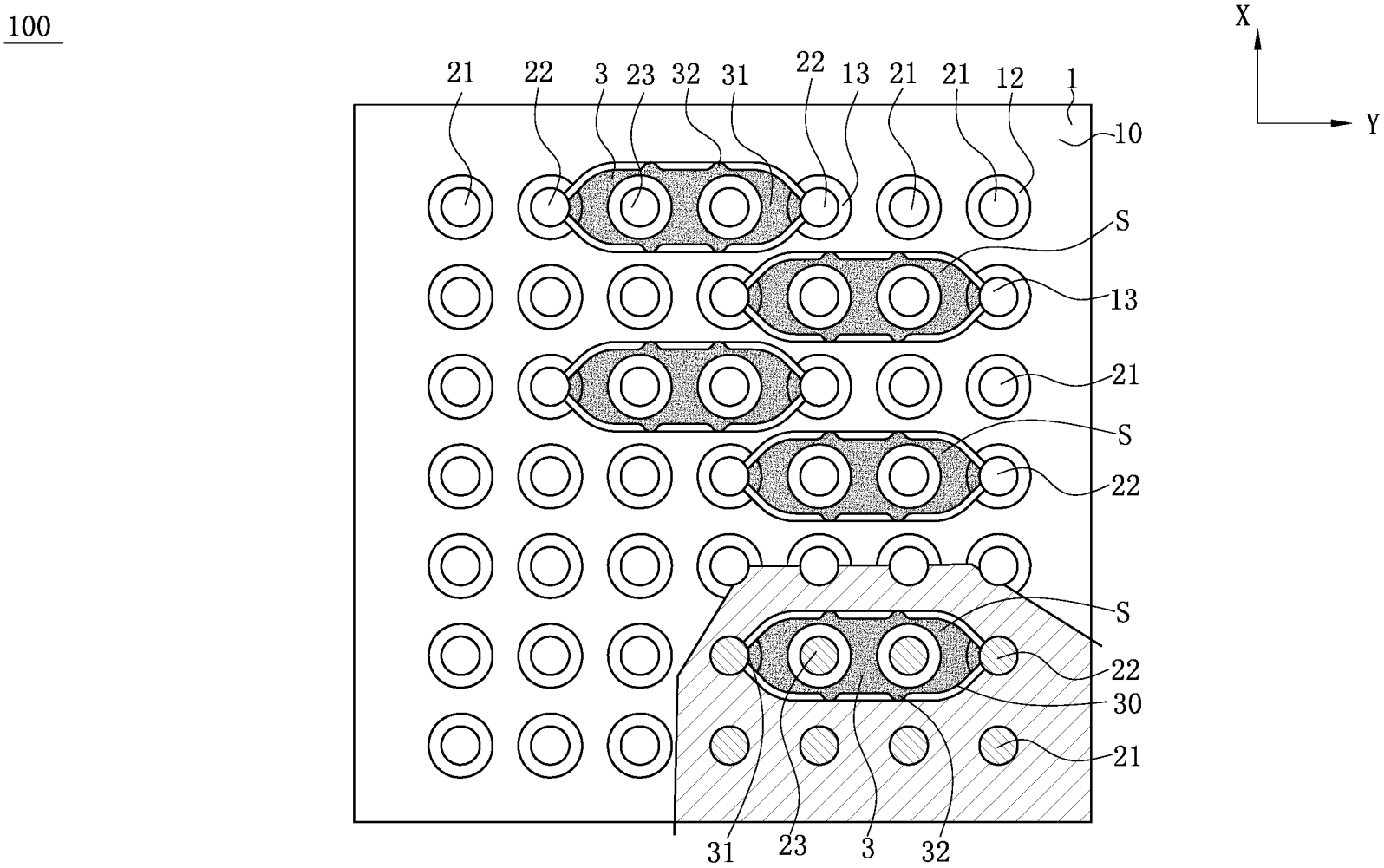
FIG. 6 is a part sectional view of the electrical connector in FIG. 5.

FIG. 5 and FIG. 6 show an electrical connector 100 according to a second embodiment of the present invention, which is different from the electrical connector 100 of the first embodiment in that multiple rigid bumps 32 protrude from the outer side surface 30. The rigid bump 32 abut and are in contact with the wall surface of the installation hole 14, and the contact therebetween is a point contact. The electrical connection between the terminal 2 and the circuit board 300 is fixed by soldering. When the electrical connector 100 passes through a high-temperature soldering furnace, the body 1 and the plastic block 3 deform. Since the coefficients of thermal expansion of the plastic block 3 and the body 1 are different, the deformation thereof are different, thereby affecting the positioning of the plastic block 3 in the corresponding installation hole 14. The rigid bumps 32 and the wall surface of the installation hole 14 are in point contact and are fixed with an interference, such that even if the body 1 is deformed, the rigid bumps 32 can well abut the wall surface of the installation hole 14, thereby facilitating positioning of the plastic block 3 in the installation hole 14.

To sum up, the electrical connector 100 according to certain embodiments of the present invention has the following beneficial effects:

1. The ground terminals 21 and the wall surface of the first accommodating grooves 12 abut and attach face to face, such that a certain contact area is ensured. The body 1 is made of a wave-absorbing material, such that the resonance of the ground terminal 21 can be well eliminated. Moreover, each ground terminal 21 is in contact with the wall surface of the corresponding first accommodating groove 12, such that a magnetic field absorbed by the body 1 is conducted out of the electrical connector 100, thereby facilitating reducing the magnetic field interference of the differential signal terminal 23, adjusting the characteristic impedance of the terminal 1, and reducing the insertion loss and the return loss.

2. The body 1 is made of a wave-absorbing material capable of absorbing magnetic field energy, which absorbs an outwardly radiated magnetic field of a pair of differential signal terminals 23, and absorbs magnetic field energy between a pair of differential signal terminals 23. If the differential signal terminals 23 are in direct contact with the body 1, the signal transmission of the differential signal terminals 23 will be affected, which is not conducive to the electrical property of the electrical connector 100. The plastic block 3 wraps each differential signal terminal 23, such that the differential signal terminals 23 and the body 1 do not contact each other, thereby facilitating transmitting a high frequency signal by the differential signal terminals 23.

3. A current loop is formed between each shielding terminal 22 and the adjacent differential signal terminal 23. Since each shielding terminal 22 is exposed in the corresponding installation hole 14 and is attached to the wall surface of the corresponding notch 31, the plastic block 3 is partially provided between the shielding terminal 22 and the adjacent differential signal terminal 23, and the magnetic field energy between the shielding terminal 22 and the adjacent differential signal terminal 23 is not absorbed by the wave-absorbing material, thereby facilitating the stabilization of the current loop, further keeping stable impedance, and thus facilitating the electrical property of the electrical connector 100.

4. The installation hole 14 on the first straight line L1 and the installation hole 14 on the adjacent second straight line L2 are provided at an interval and are not communicated with each other. A wave-absorbing material exists between two pairs of differential signal terminals 23 in front and rear rows to absorb a magnetic field between the two pairs of differential signal terminals 23 in the front and rear rows, thereby reducing the crosstalk between the two pairs of differential signal terminals 23 in the front and rear rows, reducing the insertion loss and the return loss, and facilitating the high frequency performance of the electrical connector 100.

5. The installation holes 14 in two adjacent first straight lines L1 are provided at an interval and are not communicated with each other, and a wave-absorbing material is provided between two pairs of differential signal terminals 23 on the two adjacent first straight lines L1 and absorbs a magnetic field, thereby reducing the crosstalk, reducing the insertion loss and the return loss, and facilitating the high frequency performance of the electrical connector 100. Moreover, one ground terminal 21 and one shielding terminal 22 are provided between the two pairs of differential signal terminals 23 on the two adjacent first straight lines L1, thereby enhancing the shielding effect on a magnetic field between the two pairs of differential signal terminals 23 on the two adjacent first straight lines L1, reducing the crosstalk, reducing the insertion loss and the return loss, and facilitating the high frequency performance of the electrical connector 100.

6. Multiple rigid bumps 32 protrude from the outer side surface 30. The rigid bump 32 abut and are in contact with the wall surface of the installation hole 14, and the contact therebetween is a point contact. The electrical connection between the terminal 2 and the circuit board 300 is fixed by soldering. When the electrical connector 100 passes through a high-temperature soldering furnace, the body 1 and the plastic block 3 deform. Since the coefficients of thermal expansion of the plastic block 3 and the body 1 are different, the deformation thereof are different, thereby affecting the positioning of the plastic block 3 in the corresponding installation hole 14. The rigid bumps 32 and the wall surface of the installation hole 14 are in point contact and are fixed with an interference, such that even if the body 1 is deformed, the rigid bumps 32 can well abut the wall surface of the installation hole 14, thereby facilitating positioning of the plastic block 3 in the installation hole 14.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, mounted on a circuit board and configured to mate with a mating member, the electrical connector comprising:

a body made of a wave-absorbing material, the body having an upper surface, a lower surface, at least one installation hole and at least one first accommodating groove; and at least one ground terminal, accommodated in the first accommodating groove, wherein an upper end of the ground terminal is exposed to the upper surface and is in electrical contact with the mating member, and a lower end of the ground terminal is exposed to the lower surface and is electrically connected with the circuit board; and a signal module, having at least one signal terminal and a plastic block wrapping the signal terminal, wherein the plastic block is accommodated in the installation hole, an upper end of the signal terminal is exposed to the upper surface and is in electrical contact with the mating member, a lower end of the signal terminal is exposed to the lower surface and is electrically connected with the circuit board, and the signal terminal and the body are not in contact with each other.

2. The electrical connector of claim 1, wherein the body further has at least one second accommodating groove located at one side of the installation hole and is communicated with the installation hole, at least one shielding terminal is accommodated in the second accommodating groove and is partially exposed to the installation hole, an upper end of the shielding terminal is in electrical contact with the mating member, and a lower end of the shielding terminal is electrically connected with the circuit board.

3. The electrical connector of claim 2, wherein the second accommodating groove is concavely formed on an inner wall of the installation hole.

4. The electrical connector of claim 2, wherein the plastic block has at least one notch configured to reserve a space for the corresponding shielding terminal, and an inner wall of the notch and an inner wall of the second accommodating groove jointly clamp the corresponding shielding terminal.

5. The electrical connector of claim 2, wherein the shielding terminal is cylindrical, and the shielding terminal and the second accommodating groove are provided to attach each other and jointly define an attachment radian, wherein the attachment radian is greater than or equal to 180°.

6. The electrical connector of claim 1, comprising a plurality of ground terminals, wherein the signal module has a plurality of signal terminals, a front-rear direction and a left-right direction are defined, a size of the installation hole in the front-rear direction is smaller than a size of the installation hole in the left-right direction, the body further has a plurality of first accommodating grooves and a plurality of installation holes configured to accommodate the ground terminals and the signal terminals respectively, each two of the installation holes are not communicated, the body defines a first straight line and a second straight line parallel to each other and provided in the front-rear direction, the first accommodating grooves and the installation holes are arranged in a first row and a second row, the first row is provided along the first straight line and comprises a plurality of the first accommodating grooves and at least one of the installation holes, and the second row is provided along the second straight line and comprises a plurality of the first accommodating grooves and at least one of the installation holes.

7. The electrical connector of claim 6, wherein the installation hole on the first straight line and the installation hole on the adjacent second straight line are staggeredly provided.

8. The electrical connector of claim 6, wherein the body defines two first straight lines, the two first straight lines and the second straight line are parallel to each other and provided in the front-rear direction, the first accommodating grooves and the installation holes are arranged in two first rows and one second row, each of the first rows is provided along one of the first straight lines and comprises a plurality of the first accommodating grooves and at least one of the installation holes, the second row is provided along the second straight line and comprises a plurality of the first accommodating grooves and at least one of the installation holes, and at least one of the ground terminals provided along the second straight line is located between the installation holes provided along the two first straight lines.

9. The electrical connector of claim 6, wherein each of the signal terminals is aligned to one of the ground terminals in the front-rear direction.

10. The electrical connector of claim 6, wherein the body further defines a third straight line parallel to the first straight line and the second straight line, the first straight line, the second straight line and the third straight line are provided in the front-rear direction, the first accommodating grooves and the installation holes are arranged in the first row, the second row and a third row, the third row is provided along the third straight line and comprises only a plurality of the first accommodating grooves.

11. The electrical connector of claim 1, wherein the plastic block has at least one rigid bump abutting an inner wall of the installation hole.

12. The electrical connector of claim 11, wherein the rigid bump and the inner wall of the installation hole are in point contact.

13. The electrical connector of claim 1, wherein the plastic block has an outer side surface facing an inner wall of the installation hole, and the outer side surface at least partially attaches to the inner wall of the installation hole.

14. The electrical connector of claim 1, wherein the ground terminal is cylindrical shaped, and an inner wall of the first accommodating groove is circular shaped matching with a circular outer surface of the ground terminal.

15. An electrical connector, mounted on a circuit board and configured to mate with a mating member, the electrical connector comprising:

a body made of a wave-absorbing material, the body having an installation hole;

a plastic block, accommodated in the installation hole;

at least one signal terminal, provided in the plastic block, and configured to electrically connect the circuit board and the mating member; and at least one shielding terminal, accommodated in the installation hole and located at an outer side of the plastic block, wherein the shielding terminal is in contact with the body, and the plastic block has at least one notch configured to reserve a space for the corresponding shielding terminal.

16. The electrical connector of claim 15, further comprising at least one ground terminal, wherein the body has at least one first accommodating groove, and the ground terminal is accommodated in the first accommodating groove and abuts an inner wall of the first accommodating groove.

17. The electrical connector of claim 16, wherein the body has at least one second accommodating groove configured to accommodate the shielding terminal, the second accommodating groove is communicated with the installation hole, and an upper end of the shielding terminal is in electrical contact with the mating member.

18. The electrical connector of claim 17, wherein the shielding terminal is cylindrical, and the shielding terminal and the second accommodating groove are provided to attach each other and jointly define an attachment radian, wherein the attachment radian is greater than or equal to 180°.

19. The electrical connector of claim 18, wherein an inner wall of the notch and an inner wall of the second accommodating groove jointly clamp the corresponding shielding terminal.

* * * * *